US005242513A

United States Patent [19]

Kobayashi et al.

[11] Patent Number: 5,242,513

[45] Date of Patent: Sep. 7, 1993

[54] METHOD OF PREPARING ON AMORPHOUS ALUMINUM-CHROMIUM BASED ALLOY

[75] Inventors: Kojiro Kobayashi; Yoshinobu Takeda, both of Osaka, Japan

[73] Assignee: Sumitomo Electric Industries, Ltd., Osaka, Japan

[21] Appl. No.: 773,636

[22] PCT Filed: Mar. 13, 1991

[86] PCT No.: PCT/JP91/00336

§ 371 Date: Nov. 27, 1991

§ 102(e) Date: Nov. 27, 1991

[87] PCT Pub. No.: WO91/14013

PCT Pub. Date: Sep. 19, 1991

[30] Foreign Application Priority Data

Mar. 15, 1990 [JP] Japan ..... 2-65650

[51] Int. Cl.[5] ..... C22C 45/08

[52] U.S. Cl. ..... 148/561; 75/351

[58] Field of Search ..... 420/550, 551; 148/403, 148/156; 428/614; 75/351

[56] References Cited

U.S. PATENT DOCUMENTS

| | | | |
|---|---|---|---|
| 4,347,076 | 8/1982 | Ray et al. | 420/551 |
| 4,383,970 | 5/1983 | Komuro et al. | 420/551 |
| 4,789,605 | 12/1988 | Kubo et al. | 428/614 |
| 5,028,494 | 7/1991 | Tsujimura et al. | 428/614 |
| 5,053,084 | 10/1991 | Masumoto et al. | 148/403 |

FOREIGN PATENT DOCUMENTS

| | | |
|---|---|---|
| 58-11500 | 3/1983 | Japan . |
| 63-153237 | 6/1988 | Japan . |
| 64-47831 | 2/1989 | Japan . |
| 1-127641 | 5/1989 | Japan . |
| 1-275732 | 11/1989 | Japan . |

OTHER PUBLICATIONS

Japanese Institute of Metals, vol. 28, No. 12, p. 968.

Transactions of the Japan Institute of Metals. vol. 28, No. 8 (1987), p. 679 "Formation of Al-Cr Quasicrystal Films by RF-Sputtering".

*Primary Examiner*—George Wyszomierski

*Attorney, Agent, or Firm*—W. G. Fasse

[57] ABSTRACT

An aluminum-chromium based alloy which has a high strength, an excellent heat resistance, corrosion resistance, and a light weight contains 10 to 25 atomic percent of Cr and 0.1 to 5.0 atomic percent of Fe and/or Ni. The total content of Cr, and Fe and/or Ni is not more than 30 atomic percent The remainder substantially consists of aluminum. The aluminum-chromium based alloy partially or entirely exhibits and amorphous state by X-ray diffraction. This aluminum-chromium based alloy is obtained by first preparing a powder by a rapid solidification method, then converting the powder raw material to an amorphous powder by performing a mechanical grinding treatment thereon, and then hot working the amorphous powder.

8 Claims, 4 Drawing Sheets

METHOD OF PREPARING ON AMORPHOUS ALUMINUM-CHROMIUM BASED ALLOY

FIELD OF THE INVENTION

The present invention relates to an aluminum-chromium based alloy and a method of preparing the same, and more particularly, it relates to an aluminum-chromium based alloy which has high strength and an excellent heat resistance, corrosion resistance and the like.

BACKGROUND INFORMATION

Amorphous aluminum alloys are disclosed in Japanese Patent Laying-Open Gazette No. 1-275732, Japanese Patent Laying-Open Gazette No. 64-47831 and Japanese Patent Publication Gazette No. 1-127641, for example. The amorphous aluminum alloys disclosed in these Japanese Patent Publications contain La, or Nb, Ta, Hf, Y and the like as essential alloy components. An Al-Si-X alloy and an Al -Ce-X alloy are described in Transactions of the Japan Institue of Metals, Vol. 28, No. 12, p. 968.

The amorphous alloys disclosed in the aforementioned prior art examples are prepared by a super-rapid solidification method in most cases. According to another method an amorphous alloy can be prepared by a mechanical alloying method. In addition to the aforementioned two methods, a vapor phase deposition method, an electrolytic deposition method, an electron beam irradiation method, an extra-high pressure method and the like are known as methods for obtaining amorphous alloys. However, these methods have not yet been industrialized due to considerable practical limitations.

An amorphous alloy prepared by the super-rapid solidification method or the mechanical alloying method has not satisfied both, mechanical and economical properties. In other words, an amorphous alloy having excellent mechanical properties contains high-priced elements. An amorphous alloy containing only low-priced elements has inferior mechanical properties. An amorphous alloy is crystallized by heating. If the crystallization temperature of the amorphous alloy is too low, it is impossible to perform a sufficient warm solidification of the alloy powder. Also with a view to actual use, it is difficult to use such an amorphous alloy having a low crystallization temperature since the upper limit of the available temperatures is lowered.

SUMMARY OF THE INVENTION

It is an object of the present invention to provide an aluminum-chromium based alloy which can satisfy both mechanical and economical properties.

Another object of the present invention is to provide an aluminum-chromium based alloy which has a high crystallization temperature.

Still another object of the present invention is to provide a method for preparing an aluminum-chromium based alloy which can satisfy both mechanical and economical properties.

A further object of the present invention is to provide a method of preparing an aluminum-chromium based alloy which has a high crystallization temperature.

It has been found that an aluminum-chromium based alloy containing an amorphous phase can be obtained by preparing an Al-Cr-X based alloy by a novel method. It has also been found that the above described aluminum-chromium based alloy containing an amorphous phase has a high crystallization temperature, and has excellent material characteristics. Such an Al-Cr-X based alloy is also economical since low-priced Cr is used as a raw material An attempt for obtaining an Al-Cr amorphous alloy is disclosed in Transactions of the Japan Institute of Metals, Vol. 28, No. 8 (1987), p. 679, for example. While a vapor-phase method, i.e., an RF sputtering method, is employed in this prior art, only a quasi-crystalline structure, which is thermodynamically more stable than an amorphous phase, is obtained by this method. In general, it has been recognized that absolutely no amorphous phase is obtained in an Al-Cr based alloy even if a super-rapid solidification method or a mechanical alloying method is employed.

As described above, it has been difficult to convert an A -Cr based alloy to an amorphous state. In order to implement such amorphous conversion of an Al-Cr based alloy, the inventors have found the following two points to be important.

(1) Additional element groups for facilitating amorphous conversion and a novel alloy composition.

(2) A novel preparation method including a novel thermomechanical working treatment method implementing conversion to an amorphous state.

An aluminum-chromium based alloy according to the present invention contains 10 to 25 atomic percent of Cr, and 0.1 to 5.0 atomic percent of at least one element selected from a group of Fe and Ni. The total content of Cr, and Fe and/or Ni is not more than 30 atomic percent. The rest substantially consists of aluminum. This aluminum-chromium based alloy partially or entirely exhibits an amorphous structure by X-ray diffraction or electron beam diffraction.

The aforementioned aluminum-chromium based alloy is prepared by the following method according to the invention.

In one aspect, the method of preparing an aluminum-chromium based alloy comprises a step of obtaining a foil or powder raw material from a melt by a rapid solidification method, a step of producing a powder, which is converted to an amorphous state by performing a mechanical grinding treatment or a mechanical working treatment equivalent thereto on the raw material, and a step of performing a hot working of the amorphous powder.

In another aspect, the present method of preparing an aluminum-chromium based alloy comprises a step of obtaining an aluminum-chromium binary system alloy powder from a melt of an aluminum-chromium binary system alloy by a rapid solidification method, and a step of alloying any remaining elements other than aluminum and chromium in the aluminum-chromium binary system alloy powder by a mechanical alloying method.

In still another aspect, the present method of preparing an aluminum-chromium based alloy comprises a step of obtaining crystalline powder by alloying industrial pure aluminum powder, pure chromium or an aluminum mother alloy containing chromium, and remaining elements other than aluminum and chromium or mother alloys of the elements by a mechanical alloying method, a step of partially or entirely converting the crystalline powder to an amorphous state by a thermal activation annealing treatment, and a step of hot working of the amorphous powder.

The additional element groups described in the above point (1) are adapted to facilitate the formation of an amorphous phase when an aluminum-chromium based alloy is prepared by the method described in the above point (2). In particular, it is conceivable that Fe and Ni of the first group are essential elements for converting the aluminum-chromium based alloy to an amorphous state. Ti, Zr, Si, V, Nb, Mo, W, Mn, Co and Hf of the second group are elements for improving various characteristics of the alloy without much inhibiting the conversion of the aluminum-chromium based alloy to the amorphous state.

While no clarification has been made as to what metallurgical action the elements of the first group have on the aluminum-chromium based alloy, it is conceivable that the presence of Fe and Ni hinders an immediate transition from a simply mixed state, which is thermodynamically most instable, or a supercooled liquid, which is in a next instable state, to a crystalline phase, which is an equilibrium stable phase, and provides an opportunity for remaining in a metastable amorphous phase. The upper limit of the content of the first group elements is 5 atomic percent, since amorphous conversion may be hindered if the content exceeds this limit. The lower limit of the content of the first group elements is 0.1 atomic percent, since no amorphous conversion is obtained if the content is less than this limit.

In consideration of the relation between the first group of an element or elements of Fe and/or Ni and Al-Cr, which are basic alloy elements, a preferable content of Cr is 10 to 25 atomic percent. If the content of Cr is at least 10 atomic percent, the mechanical properties of the aluminum-chromium based alloy are deteriorated and an amorphous conversion hardly occurs. If the Cr content exceeds 25 atomic percent, a lightweight is not obtained and the characteristics desirable for a practical material are deteriorated in view of toughness and the like. Further, amorphous conversion hardly occurs.

In order to facilitate the amorphous conversion without reducing the low density of the aluminum-chromium based alloy, the total content of Cr, and Fe and/or Ni must be not more than 30 atomic percent.

Although the relationship between the function of the second group of elements consisting of Ti, Zr, Si, V, Nb, Mo, W, Mn, Co and Hf and the mechanism of the amorphous conversion is not clear, the effect of improving the physical, chemical or mechanical properties of the aluminum-chromium based alloy without hindering the amorphous conversion, is obtained by the addition of the second group of elements. If the content of the second group elements exceeds 30 atomic percent, however, the original characteristics of the Al-Cr based alloy are damaged.

There is not necessarily available a fixed criterion for verification of an amorphous material. X-ray diffraction is the simplest method for deciding whether or not a material is amorphous. When a prepared alloy is subjected to X-ray diffraction, a sharp diffraction peak appears from a crystal plane if the alloy is crystalline. If no such sharp diffraction peak appears but something like a trace of an extremely spread diffraction peak is recognized, it is possible to decide that the material is macroscopically amorphous.

Electron beam diffraction is a method for further macroscopically confirming the presence of an amorphous phase. When a structure specified by observation with a transmission electron microscope is diffracted by electron beams, it is possible to decide that the structure is amorphous if the so-called halo pattern, which is not recognized in a crystalline material, vaguely appears without an appearance of a regular diffraction line and without a diffraction point group.

In addition to X-ray diffraction and electron beam diffraction, there is still another method for deciding whether or not a material is amorphous. For example, a DSC (differential scanning calorimeter) analysis enables one to decide whether or not a material has been amorphous, with an exothermic reaction in crystallization by heating. However, this analysis method is not suitable for state analysis of the present alloy since it requires heating. In the DSC analysis, further, it is difficult to make a correct decision when a part of the material is amorphous and the rest is crystalline. On the other hand, an amorphous phase can be identified by electron beam diffraction with a very good sensitivity since it is possible to specify the structure in nanometer units.

Thus, the essential condition of the present invention has been met in that the aluminum-chromium based alloy has an amorphous structure which is identified by X-ray diffraction or electron beam diffraction.

A method of preparing an amorphous phase according to the present invention is different from conventional methods. According to the invention it is possible to obtain an amorphous phase in two ways.

The first method produces an amorphous phase by performing a mechanical grinding treatment on powder or foil which has been obtained by a rapid solidification method. The rapid solidification method has frequently been used as a method for obtaining an amorphous phase. As to an Al-Cr based alloy, however, only a quasi-crystalline phase, which is close to an amorphous phase but not quite fully amorphous, has been obtained even if the phase was rapidly solidified under the best conditions. It has been found that it is possible to thermodynamically convert this quasi-crystalline phase to an amorphous phase by mechanically grinding the same. The material may not necessarily have a quasi-crystalline structure before the same is subjected to a mechanical grinding treatment. However, it is preferable to subject the material to mechanical grinding following the rapid solidification. According to the rapid solidification method, it is possible to implement such as state that Al atoms and Cr atoms, which are principle elements, are homogeneously mixed yet so as not to form coarse intermetallic compounds or the like.

Throughout this specification rapid solidification means that the solidification rate is at least $10^3$K/sec., which is a solidification rate attained by a general atomizing method, a splash cooling method or the like. With an increase in the solidification rate, the solidified structure of the Al-Cr based alloy is refined and supersaturated dissilution elements such as Cr in Al progress to cause a refinement of the intermetallic compounds, and finally a quasi-crystalline structure starts to appear, so that the entire alloy enters a quasi-crystalline state in the end. Amorphous conversion by mechanical grinding is facilitated by an increase of the solidification rate, because the thermodynamic state of an intermediate product gradually approaches the state of an amorphous phase with an increase in the solidification rate.

It has been found that a remarkable effect is obtained by the mechanical grinding of an Al-Cr based alloy. Namely, milling, mixing and adhesion and/or aggregation of powder are repeated by mechanical working so that the interior of the powder is homogeneously mixed not only in macroscopic units but also in atomic units and thermodynamically activated into an extremely instable state by an increase in grain boundary energy caused by the refinement and lamination, and phase transition from such an instable state to a metastable amorphous phase is further enabled.

In the aforementioned first method, the first group elements and/or the second group elements may be added during the rapid solidification or during the mechanical grinding. The first group of elements are preferably added during mechanical grinding since it is easier to add the same during mechanical grinding than during rapid solidification. It is also preferable to add a high melting point element or an oxidizable element during the mechanical grinding, in order to avoid a dissolution problem.

The difference between mechanical alloying (MA) and mechanical grinding (MG) will now be described.

Mechanical alloying is a treatment which is adapted to perform complex working processes such as mechanical mixing, pulverization and aggregation on at least one type of raw material powder containing elements for forming the composition of the target alloy so that individual particles have the target alloy composition as well as microscopically homogeneous structures.

On the other hand, mechanical grinding is a treatment which is adapted to perform complex working processes such as mechanical working, pulverization and aggregation on an alloy powder having the composition of the target alloy, thereby introducing distortion, lattice defects, etc. into the alloy powder. While mechanical alloying changes the alloy components of the powder, mechanical grinding is not mainly directed to changing the alloy components. Although contamination of unavoidable impurities may be caused by mechanical grinding, such contamination is not a problem herein.

Comparing mechanical alloying and mechanical grinding with each other, these treatments use different starting raw materials. As to actual operations, however, these treatments can be performed with absolutely identical apparatuses and conditions. For example, a high-energy ball mill called an attriter, a general ball mill, a planetary ball mill, a vibrating mill, a centrifugal mill (angmill) or the like may be employed for both mechanical alloying and mechanical grinding.

In the second method according to the present invention, the final composition alloy is not obtained by a dissolution step. Namely, the second method according to the present invention is a novel method for obtaining an amorphous phase, which cannot be obtained by mechanical alloying alone, by preparing a crystalline powder which is microscopically and atomically homogeneously mixed as an intermediate raw material by mechanical alloying and thereafter performing a thermal activation annealing treatment on this powder. Although it is known that an amorphous phase can be produced by mechanical alloying alone depending on the alloy components, the composition range thereof is extremely restricted.

When an amorphous phase is heated, the same is ready for transition to a crystalline phase, which is an essentially stable system. Therefore, conversion of a material, which is not yet in an amorphous state after mechanical alloying, to an amorphous state by heating is absolutely innovative recognition against common sense. It is already known that forced solid solution and compounding in nanometer units can be implemented by mechanical alloying. After an alloy having the present composition is subjected to mechanical alloying, its structure is not an amorphous phase but a crystalline phase. This crystalline phase, which is a mixture of a compound group having compositions displaced from those of stoichiometric compounds, is in a thermodynamically high free energy state as compared with a stable stoichiometric compound having the lowest thermodynamic free energy, and at a level slightly higher than the free energy level of an amorphous phase. Thus, the inventors have found that it is possible to slightly reduce the free energy level of such a crystalline phase to convert the same to a metastable amorphous phase by performing a thermal activation annealing treatment after mechanical alloying In order to obtain a homogeneous intermediate raw material, it is necessary to use industrial pure aluminum powder, pure chromium or an aluminum mother alloy containing chromium, and other alloying elements or mother alloys of these elements. In mechanical alloying which indispensably requires an appropriate balance between cold welding, i.e., seizability, and crushing and/or dispersion of hard brittle powder, the combination of the aforementioned raw materials is important.

The thermal activation annealing treatment may be performed during a warm solidification process, or independently of such a warm solidification process. It is preferable to perform the thermal activation annealing treatment in the powder state in view of a further homogeneous treatment while the thermal activation annealing treatment is preferably performed during the warm solidification process since it is economical. In either case, it is necessary for this thermal activation annealing treatment to set an optimum temperature in a temperature range of 400 to 800 K as well as to select an optimum holding time, in accordance with the alloy to be treated.

According to either one of the aforementioned first and second methods, it is possible to obtain an amorphous phase. Either method may be arbitrarily selected. It is preferable to select either method in response to easiness of preparation of the raw material powder as well as preparation of the intermediate raw powder. In the case of an alloy which is hard to dissolve, for example, it is preferable to obtain an alloy powder having a desired composition by preparing the powder not by a rapid solidification method but by a mechanical alloying method. When an extremely long time is required for homogenization or a composition is oxidized by mechanical alloying, or a quasi-crystalline structure is obtained by rapid solidification, it is preferable to prepare the alloy powder by rapid solidification. In either method, 500 to 5000 p.p.m. of oxygen is unavoidably contained in the mixture. While it has not yet been clarified as to whether or not the contained oxygen contributes to formation of the amorphous phase, there is no evidence which would deny such contribution.

As to a powder solidification method of the present invention, it is possible to employ warm powder extrusion, powder welding, powder forging or the like, which has been used in general. Preferably, a warm solidification treatment is performed at a temperature which is higher than the glass transition point of the amorphous phase and lower than its crystallization temperature, in view of the characteristics of the amorphous phase. When the treatment is performed under this temperature condition, glass fluidity is utilized and it is possible to effectively solidify and/or form the powder into a precise and/or complicated configuration.

The aluminum-chromium based alloy may be used as a matrix, to contain second phase reinforcing materials such as particles, whiskers and short fibers in dispersed states. An aluminum-chromium based alloy containing a reinforcing dispersed layer will have more excellent composite functions. In this case, it is possible to improve bonding strength by a compounding through solidification utilizing glass fluidization, in particular.

DETAILED DESCRIPTION OF EXAMPLES

Figure 1A:
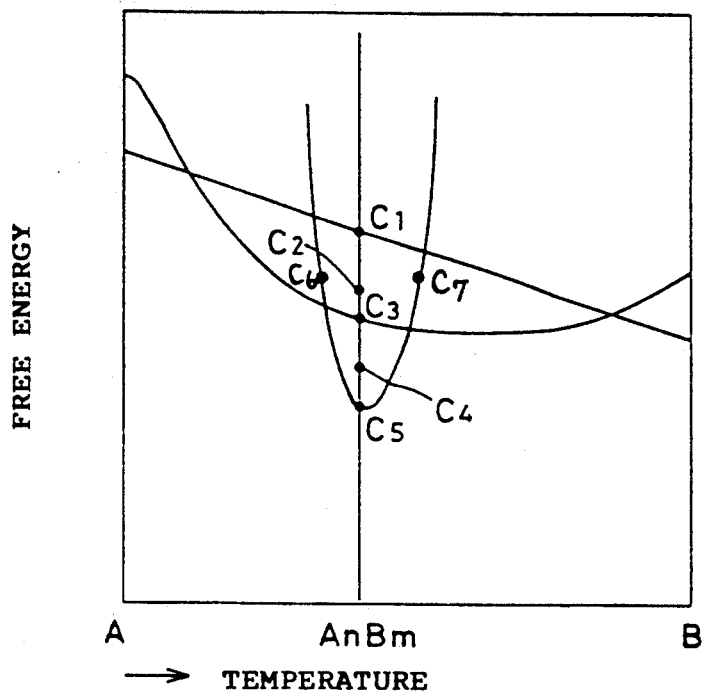
FIGS. 1A and 1B are typical diagrams showing free energy levels of binary system based alloys at arbitrary temperatures TK.

The following treatments A1 to C5 were performed on raw materials having blending compositions shown in Table 1. Table 2 shows the processes and characteristics of the so obtained alloys. The contents of the processes described in the columns of steps 1 and 2 in Table 2 are as follows:

A1 : preparation of powder by an atomizing method using an inert gas during treatment by ball mill filled with argon gas (100 hours).

A2: preparation of powder by an atomizing method using an inert gas during a mechanical alloying (attriter—50 hours).

A3: preparation of a foil member by a quenching single roll method and ball mill pulverization providing a mechanical grinding (1000 hours).

Bl: mechanical alloying (attriter — 50 hours) and thermal activation by annealing (700 K, 10 hours).

C1: CIP (cold isostatic pressing) forming . . . degassing . . . filling into a can . . . extrusion (673 K, 1:10 in extrusion ratio, 8 mm in diameter).

C2: lubrication of a metallic mold and cold forming at a pressure of 5 ton/cm$^2$ and heating in an inert gas (700 K, 20 minutes) followed by warm forging and re-sintering (700 K, 1 hour).

C3: lubrication of a metallic mold and cold forming at a pressure of 5 ton/cm$^2$ and thermal activation annealing in an inert gas (700 K, 5 hours) followed by preheating for forging (673 K, 20 minutes), warm forging, and re-sintering (700 K, 1 hour).

C4: lubrication of a metallic mold, cold forming, heating in an inert gas (800 K, 30 minutes), and glass fluidization forming and/or solidification.

C5: mixing of the reinforcing material, lubrication of metallic mold, cold forming at a pressure of 5 ton/cm$^2$, heating an inert gas (800 K, 30 minutes), and glass fluidization forming and/or solidification.

TABLE 1

| Composition | Cr | Ni | Fe | Other Element 1 | Other Element 2 | Al |
|---|---|---|---|---|---|---|
| X1 | 5 | 0.4 | 3 | | | bal |
| X2 | 10 | 0.4 | 3 | | | bal |
| X3 | 15 | 0.4 | 3 | | | bal |
| X4 | 20 | 0.4 | 3 | | | bal |
| X5 | 25 | 0.4 | 3 | | | bal |
| X6 | 30 | 0.4 | 3 | | | bal |
| Y1 | 15 | 0 | 0 | | | bal |
| Y2 | 15 | 6 | 3 | | | bal |
| Y3 | 15 | 3 | 6 | | | bal |
| Y4 | 15 | 0.4 | 3 | | | bal |
| Z1 | 20 | 0.4 | 3 | Ti-5 | V-0.25 | bal |
| Z2 | 20 | 0.4 | 3 | Zr-1 | Mo-2 | bal |
| Z3 | 20 | 0.4 | 3 | Nb-3 | Hf-1 | bal |
| Z4 | 20 | 0.4 | 3 | Si-8 | W-2 | bal |
| Z5 | 20 | 0.4 | 3 | Mn-3 | Co-1 | bal |
| W1 | 15 | 0.4 | 3 | SiC-Whisker-10 | | bal |
| W2 | 15 | 0.4 | 3 | SiC-Powder-10 | | bal |
| W3 | 15 | 0.4 | 3 | C Short Fiber-10 | | bal |

TABLE 2

| No. | Composition | Step 1 | Step 2 | Phase | Invention | Room Temperature Strength (kg/mm$^2$) | Anneal Strength (kg/mm$^2$) After Annealing at 450° C. for 100 h. | Corrosion Resistance After Salt Spray Test |
|---|---|---|---|---|---|---|---|---|
| 1 | X1 | A3 | | crystalline | NO | | | |
| 2 | X2 | A3 | | amorphous | YES | | | |
| 3 | X3 | A3 | | amorphous | YES | | | |
| 4 | X4 | A3 | | amorphous | YES | | | |
| 5 | X5 | A3 | | amorphous | YES | | | |
| 6 | X6 | A3 | | crystalline | NO | | | |
| 7 | Y1 | A2 | | crystalline | NO | | | |
| 8 | Y2 | A2 | | crystalline | NO | | | |
| 9 | Y3 | A2 | | crystalline | NO | | | |
| 10 | Y4 | A2 | | amorphous | YES | | | |
| 11 | X3 | A1 | | amorphous | YES | | | |
| 12 | Y4 | B1 | | amorphous | YES | | | |
| 13 | Z1 | A2 | | amorphous | YES | | | |
| 14 | Z2 | A2 | | amorphous | YES | | | |
| 15 | Z3 | A2 | | amorphous | YES | | | |
| 16 | Z4 | A2 | | amorphous | YES | | | |
| 17 | Z5 | A2 | | amorphous | YES | | | |
| 18 | X3 | A1 | C1 | amorphous | YES | 85 | 84 | no rusting |

TABLE 2-continued

| No. | Composition | Step 1 | Step 2 | Phase | Invention | Room Temperature Strength (kg/mm²) | Anneal Strength (kg/mm²) After Annealing at 450° C. for 100 h. | Corrosion Resistance After Salt Spray Test |
|---|---|---|---|---|---|---|---|---|
| 19 | X3 | A1 | C2 | amorphous | YES | 82 | 82 | |
| 20 | X3 | B1 | C3 | amorphous | YES | 81 | 81 | |
| 21 | X3 | A1 | C4 | amorphous | YES | 87 | 86 | |
| 22 | W1 | A1 | C5 | amorphous | YES | 90 | 90 | |
| 23 | W2 | A1 | C5 | amorphous | YES | 85 | 85 | |
| 24 | W3 | A1 | C5 | amorphous | YES | 86 | 86 | |

Figure 5:
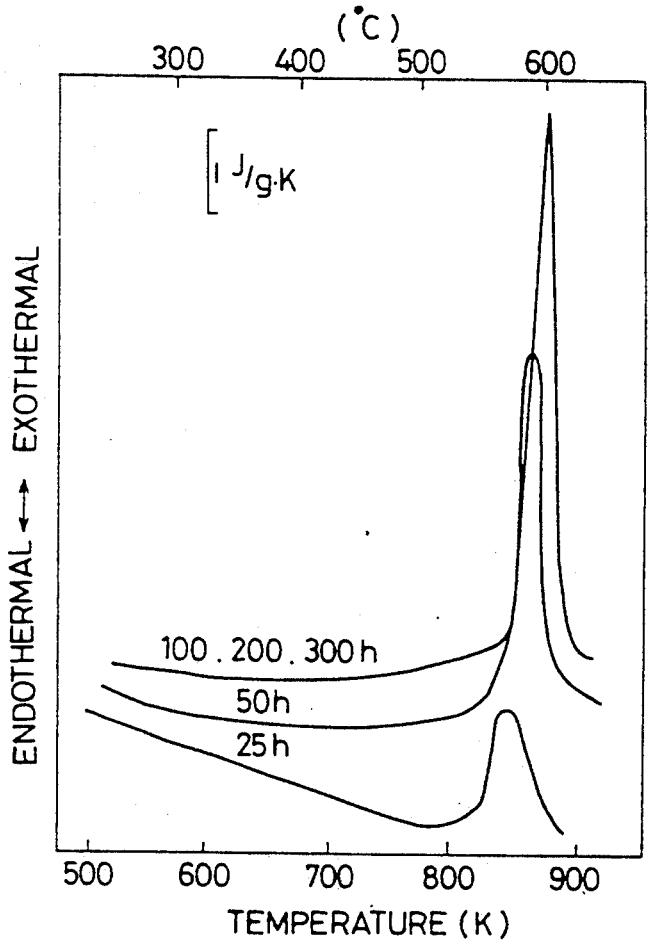
FIG. 5 is a DSC (differential scanning calorimeter) analysis diagram of pulverized powder of rapidly solidified Al-20 at. % Cr foil, which was subjected to mechanical grinding, under continuous heating.

While an abrupt deterioration of the characteristics has been recognized in a conventional amorphous alloy following a local or an instantaneous temperature rise, it is possible to prevent such an abrupt deterioration of the characteristics following a temperature rise in the amorphous alloy of the invention since the amorphous state can be maintained up to an extremely high temperature, as clearly shown by FIG. 5. Further, the present amorphous alloy has characteristics which are excellent as compared with those of a conventional crystalline type aluminum-transition element, dispersion-strengthened heat resisting alloy.

Figure 1B:
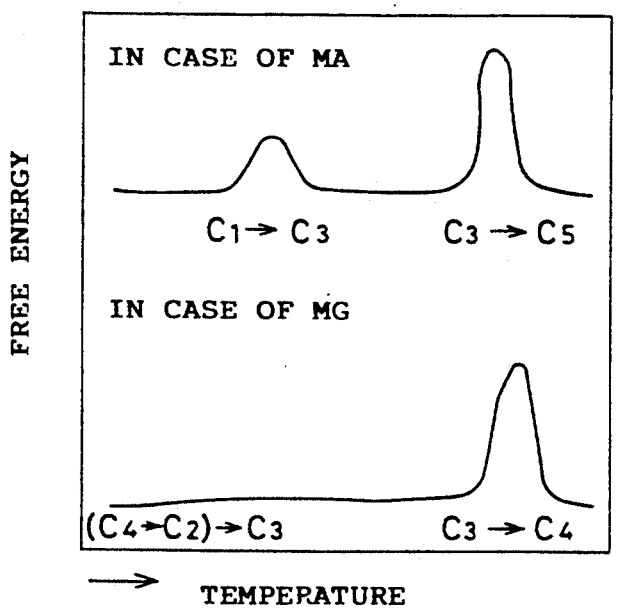

FIGS. 1A and 1B show free energy levels of binary system alloys. When the first method of the present invention is employed, quasi-crystals etc. are activated from a level of $C_4$ to a $C_2$ level by mechanical grinding, and thereafter converted to a $C_3$ level. When the second method of the present invention is employed, the quasi-crystals enter the $C_1$ to $C_2$ levels in a mechanical alloying state and are then converted to the $C_3$ level by subsequent heating. In practice, the levels of $C_1$ and $C_2$ are present as the result of a mixture of non-stoichiometric compounds ($A_{n-x}B_{m+x}$) of crystalline materials having displaced compositions of $C_6$ and $C_7$, and the composition of $A_nB_m$ is changed and distributed as $A_{n-x}B_{m+x}$. Referring to FIG. 1B, the peak of the higher temperature side shows a transition from the $C_3$ level to the $C_5$ level, i.e., energy release following crystallization.

Figure 2:
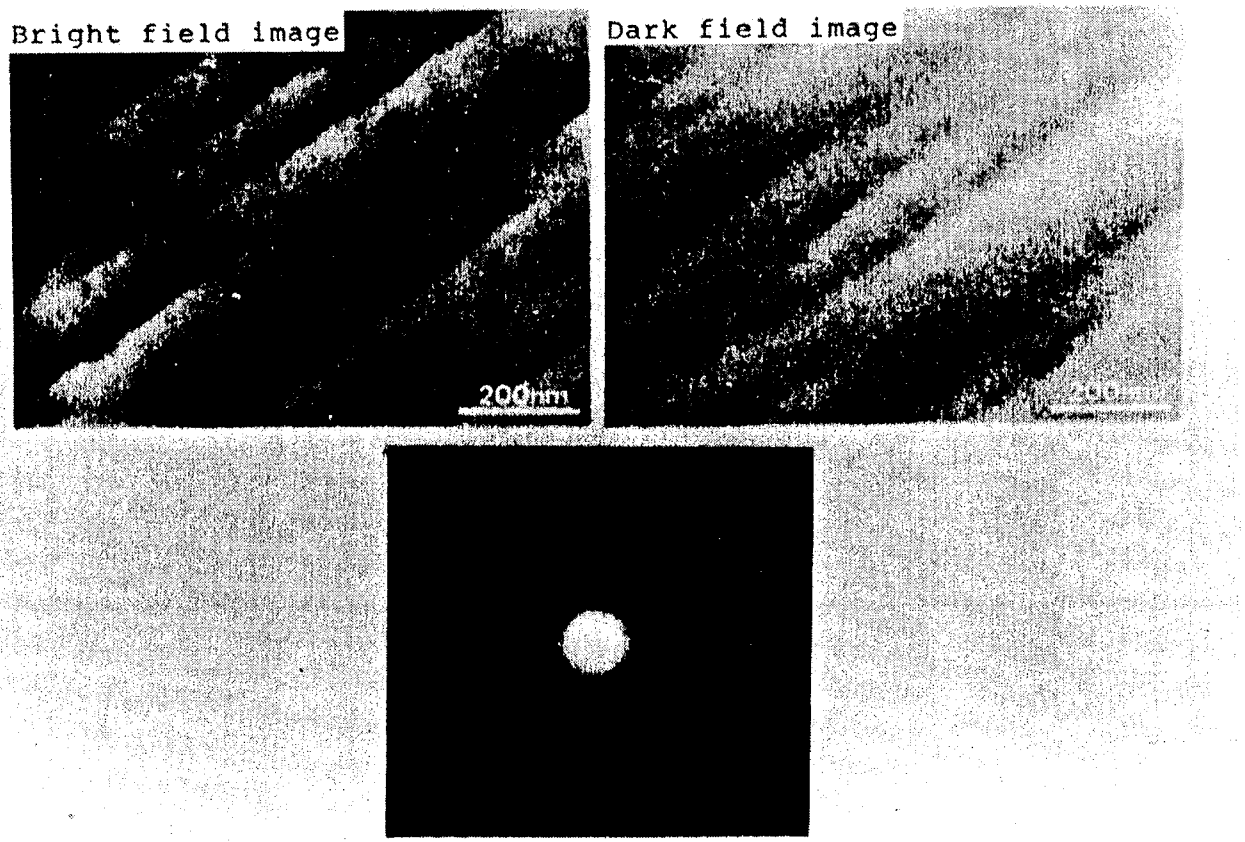
FIG. 2 shows X-ray photographs illustrating the crystal structure of Al-15% Cr powder which was annealed at 740 K after the same was subjected to mechanical alloying for 1000 hours.
Figure 3:
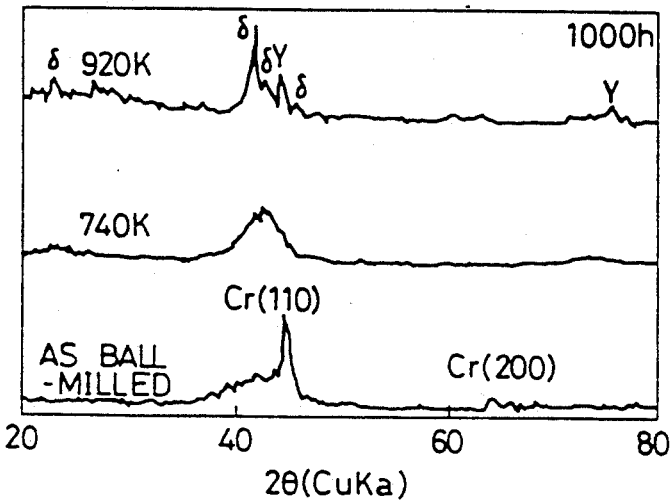
FIG. 3 shows an X-ray diffraction pattern of Al-15% Cr powder which was annealed at 740 K and 920 K after the same was subjected to mechanical alloying for 1000 hours.
Figure 4:
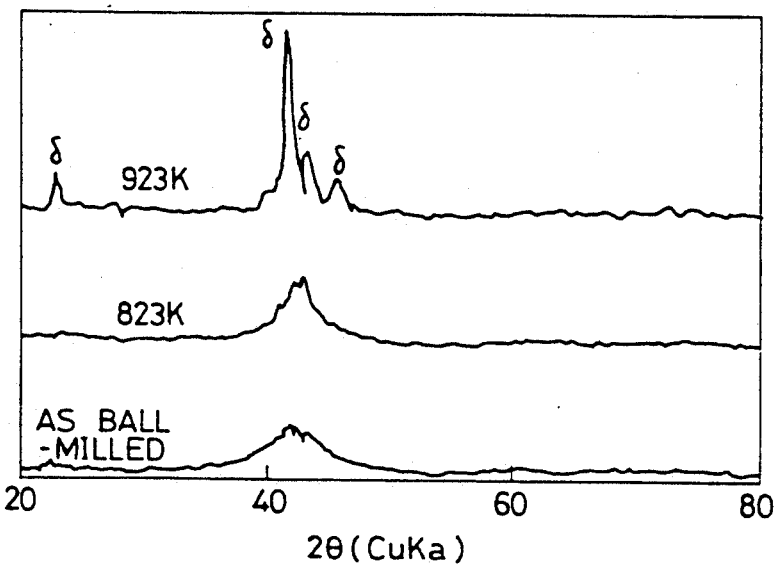
FIG. 4 is an X-ray diffraction pattern of pulverized powder of rapidly solidified Al-20 at. % Cr foil, which was subjected to mechanical grinding for 300 hours, and heating.

X-ray photographs of FIG. 2 show the crystal structure of Al-15% Cr powder, which was subjected to mechanical alloying for 1000 hours and thereafter annealed at 740 K. FIG. 3 shows an X-ray diffraction diagram of Al-15Cr powder, which was subjected to mechanical alloying for 1000 hours and thereafter annealed at 740 K and 920 K. FIG. 4 shows an X-ray diffraction diagram of pulverized powder of a rapidly solidified Al-20 at. % Cr foil, which was subjected to mechanical grinding for 30 hours while being heated. FIG. 5 shows a DSC (scanning differential thermal capacity) analysis diagram of pulverized powder of rapidly solidified Al-20 at. % Cr foil, which was subjected to mechanical grinding for the time durations shown under continuous heating.

The aluminum-chromium based alloy according to the present invention is quite suitable for industrial use since it has a strength, a heat resistance and a wear resistance comparable to those of iron and steel materials, yet the light density of an aluminum alloy as well as a corrosion resistance of an amorphous alloy. Hence, the present alloy is applicable to various uses such as in automobiles, domestic electric apparatus, industrial devices, in aircraft, in electronic apparatus, in chemical apparatus, and the like.

We claim:

1. A method of preparing an aluminum-chromium based alloy containing 10 to 25 atomic percent of Cr and 0.1 to 5.0 atomic percent of at least one element selected from a group consisting of Fe and Ni, wherein the total content of said Cr and said at least one element is not more than 30 atomic percent, and a remainder substantially consisting of aluminum.

2. The method of preparing an aluminum-chromium based alloy in accordance with claim 1, wherein said hot working is performed at a temperature higher than the glass transition point of said amorphous powder the lower than the crystallization temperature of said amorphous powder.

3. A method of preparing an aluminum-chromium based alloy containing 10 to 25 atomic percent of Cr and 0.1 to 5.0 atomic percent of at least one element selected from a group consisting of Fe and Ni, wherein the total content of said Cr and said at least one element is not more than 30 atomic percent, and a remainder substantially consisting of aluminum, said method comprising the steps of: obtaining an aluminum-chromium binary system alloy powder from a melt of an aluminum-chromium binary system alloy by a rapid solidification method, and alloying any remaining elements other than aluminum and chromium in said aluminum-chromium binary system alloy powder by a mechanical alloying method.

4. The method of preparing an aluminum-chromium based alloy in accordance with claim 3, wherein said aluminum-chromium binary system alloy powder obtained by said rapid solidification method has partially or entirely a quasi-crystalline structure.

5. A method of preparing an aluminum-chromium based alloy containing 10 to 25 atomic percent of Cr and 0.1 to 5.0 atomic percent of at least one element selected from a group consisting of Fe and Ni, wherein the total content of said Cr and said at least one element is not more than 30 atomic percent, and a remainder substantially consisting of aluminum, said method comprising the steps of: obtaining a crystalline powder by alloying industrial pure aluminum powder, pure chromium or an aluminum mother alloy containing chromium, and remaining elements other than aluminum and chromium or mother alloys of said elements, by a mechanical alloying method, partially or entirely converting said crystalline powder to an amorphous state by a thermal activation annealing treatment to provide an amorphous powder, and hot working said amorphous powder.

6. The method of preparing an aluminum-chromium based alloy in accordance with claim 5, wherein said converting step and said hot working step are carried out simultaneously.

7. The method of preparing an aluminum-chromium based alloy in accordance with claim 5, wherein said thermal activation annealing treatment is performed at a temperature within the range of 400 to 800 K.

8. The method of preparing an aluminum-chromium based alloy in accordance with claim 5, wherein said hot working step is performed at a temperature higher than the glass transition point of said amorphous powder and lower than the crystallization temperature of said amorphous powder.

* * * * *

UNITED STATES PATENT AND TRADEMARK OFFICE

CERTIFICATE OF CORRECTION

PATENT NO. : 5,242,513

DATED : September 7, 1993

INVENTOR(S) : Kojiro Kobayashi, Yoshinobu Takeda

It is certified that error appears in the above-identified patent and that said Letters Patent is hereby corrected as shown below:

On the title page: Item [54] and Column 1, line 1 "ON" should be --AN--.

In [57] ABSTRACT, line 6, after "percent" insert --.--.

In the Claims:

Claim 1, (column 10, line 21) after "aluminum" insert:

--, said method comprising the following steps: obtaining a foil or powder raw material having a quasi-crystalline structure from a melt by a rapid solidification method, converting said quasi-crystalline structure to an amorphous state by performing a mechanical grinding treatment or a mechanical working treatment equivalent thereto on said powder raw material to obtain an amorphous powder, and forming a compact of said amorphous powder by hot working--.

UNITED STATES PATENT AND TRADEMARK OFFICE

CERTIFICATE OF CORRECTION

PATENT NO. : 5,242,513

DATED : September 7, 1993

INVENTOR(S) : Kojiro Kobayashi, Yoshinobu Takeda

It is certified that error appears in the above-indentified patent and that said Letters Patent is hereby corrected as shown below:

Column 10, line 25, claim 2, replace "the" (second occurrence) with --and --.

Signed and Sealed this

Twenty-second Day of March, 1994

*Attest:*

*Attesting Officer*

BRUCE LEHMAN

*Commissioner of Patents and Trademarks*